United States Patent [19]

Mihalov

[11] Patent Number: 4,757,618

[45] Date of Patent: Jul. 19, 1988

[54] SHIP SYSTEM FOR THE RECOVERY OF FUEL OIL FROM SLUDGE REMOVED BY FLUSHING OF HEAVY OIL PURIFIERS

[75] Inventor: Mihail V. Mihalov, Sofia, Bulgaria

[73] Assignee: Kombinat "Korabostroene", Varna, Bulgaria

[21] Appl. No.: 932,634

[22] Filed: Nov. 19, 1986

[51] Int. Cl.[4] ..... F26B 23/10

[52] U.S. Cl. ..... 34/73; 34/74; 34/79; 34/177

[58] Field of Search ..... 34/73, 74, 79, 177

[56] References Cited

U.S. PATENT DOCUMENTS

| | | | |
|---|---|---|---|
| 991,905 | 5/1911 | Sleeper | 34/73 |
| 1,466,670 | 9/1923 | Monti | 34/73 |
| 2,558,206 | 6/1951 | Baird | 34/177 |
| 4,125,947 | 11/1978 | Mamistov et al. | 34/177 |
| 4,583,301 | 4/1986 | Crowley et al. | 34/177 |

*Primary Examiner*—Larry I. Schwartz

*Attorney, Agent, or Firm*—Karl F. Ross; Herbert Dubno

[57] ABSTRACT

The system comprises a settling tank with a steam heating coil, connected via a pipe conduit to a sludge pump and a sludge tank in which the sludge and fuels are collected. The settling tank is also connected to a control unit which comprises gate valves, a funnel and a drain for visual inspection of the mixture. The tank is also connected to an evaporation vessel via valves, pipe conduits and a fuel pump, while the evaporation vessel is connected to a condenser. The latter is connected to a condensate vessel via an overflow pipe. In its bottom portion the condensate vessel is connected to a disinfestation tank, and in its top portion—to the vacuum side of an ejector, the pressure side of which is connected to the condenser.

3 Claims, 4 Drawing Sheets

1
2
3
4
5
6
7
8
9
10
11
12
13
SP
WTBF
DT
OS

SHIP SYSTEM FOR THE RECOVERY OF FUEL OIL FROM SLUDGE REMOVED BY FLUSHING OF HEAVY OIL PURIFIERS

This invention relates to a ship system for the recovery of fuel oil from sludge removed by flushing of heavy oil purifiers, for the burning and complete utilization thereof in auxiliary boilers, which can find application in newly built and existing ships.

BACKGROUND OF THE INVENTION

It is known that newly built ships are equipped with an incinerator in which the aforementioned fuels are burned through a nozzle, while a second nozzle, operating with gas oil, provides for the continuity of their burning. The released energy is not utilized.

The ships without incinerators pump out the removed fuels in the sea since most harbors lack facilities for their receipt, while doing so would be prohibitively expensive, and the small volume of the sludge tanks does not permit the collection of quantities sufficient for travel between two harbors.

OBJECT OF THE INVENTION

It is therefore a general object of this invention to provide a system for the recovery of fuel oil from sludge by the desiccation of sludge removed by flushing of heavy oil purifiers, which are in a state of stable oil-water emulsion with a water content lower than 2%, with observation of the requirements for environmental protection.

SUMMARY OF THE INVENTION

This object is achieved in a system comprising a settling tank with a steam heating coil, connected via a pipe conduit to a sludge pump and a sludge tank, in which the fuels and sludge are collected. The settling tank is also connected to a control unit which comprises gate valves, a funnel and a drain. The tank is also connected to an evaporation vessel via valves, pipe conduits and a fuel pump, while the evaporation vessel is connected to a condenser. The latter is connected to a condensate vessel via an overflow pipe. In its bottom portion the condensate vessel is connected to a disinfestation tank, and in its top portion—to the vacuum side of an ejector, the pressure side of which is connected to the condenser.

The evaporation vessel consists of a housing with a cover within the housing there is mounted a heating coil, over which there is mounted a toroid formed with perforations along the bottom surface thereof. In the cover there is disposed a demister which comprises a grid and metal chips.

The condenser consists of a housing with a cover. In this housing there is mounted a diaphragm formed with perforations at its bottom side and traversed by an overflow pipe. Underneath the diaphragm there is disposed a cooling coil.

The advantages of the system according to the invention lie in that the energy of the removed fuels is utilized without any water getting in the furnace space of the boiler, and the environment is protected.

BRIEF DESCRIPTION OF THE DRAWING

For a better understanding of the invention reference is made to the accompanying drawings, in which.

SPECIFIC DESCRIPTION

Figure 1:
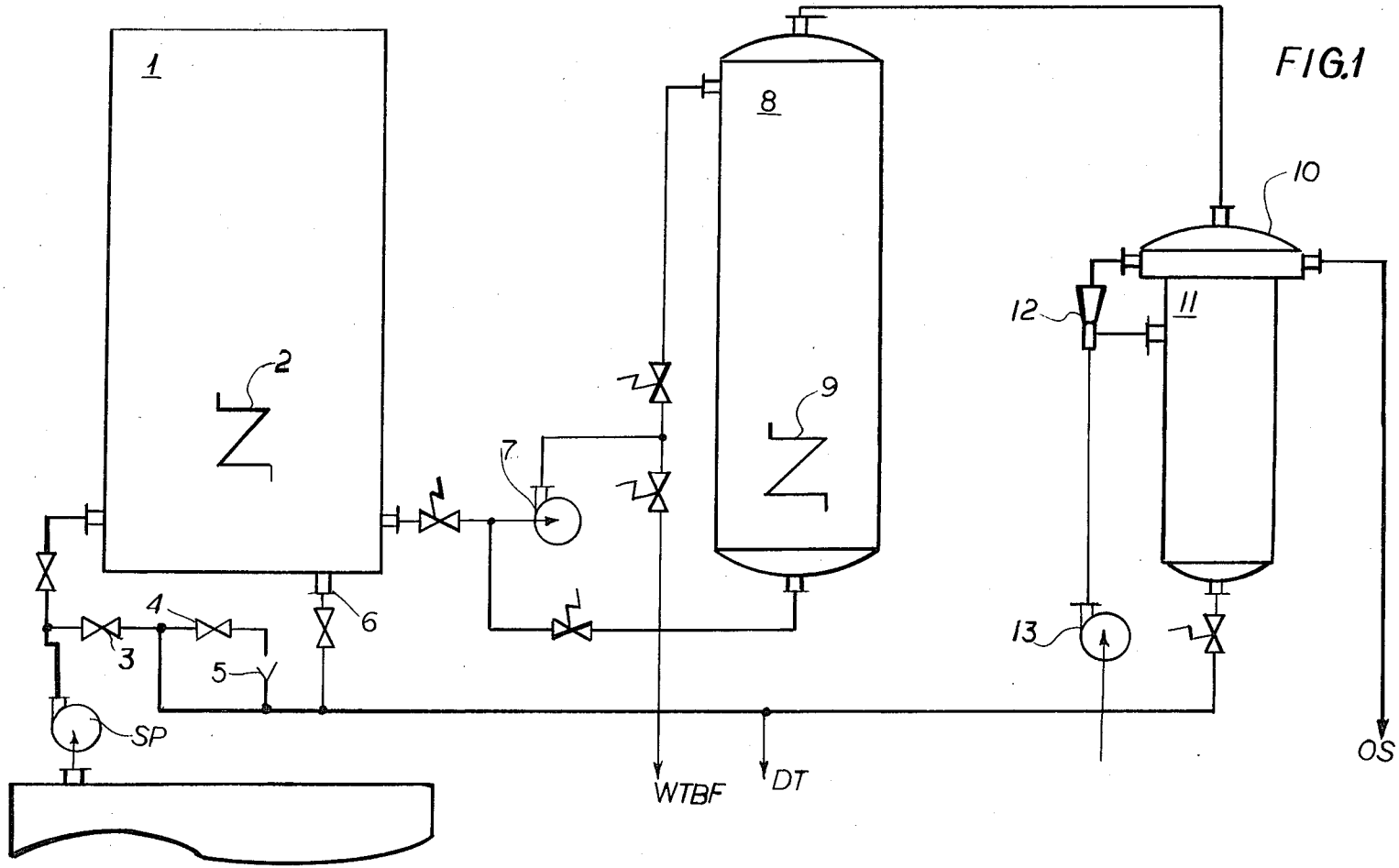
FIG. 1 is a diagrammatical illustration of the connection of the component units of the system.
Figure 4:
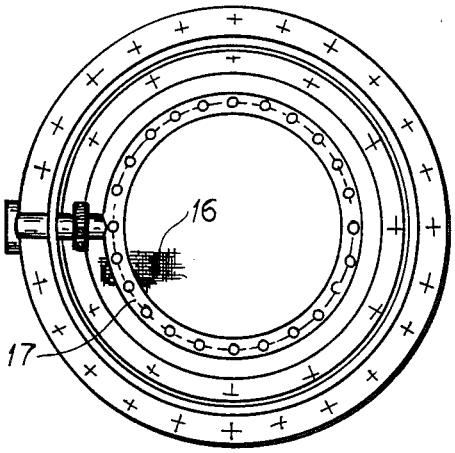
FIG. 4 is a sectional view along A—A in FIG. 2.
Figure 2:
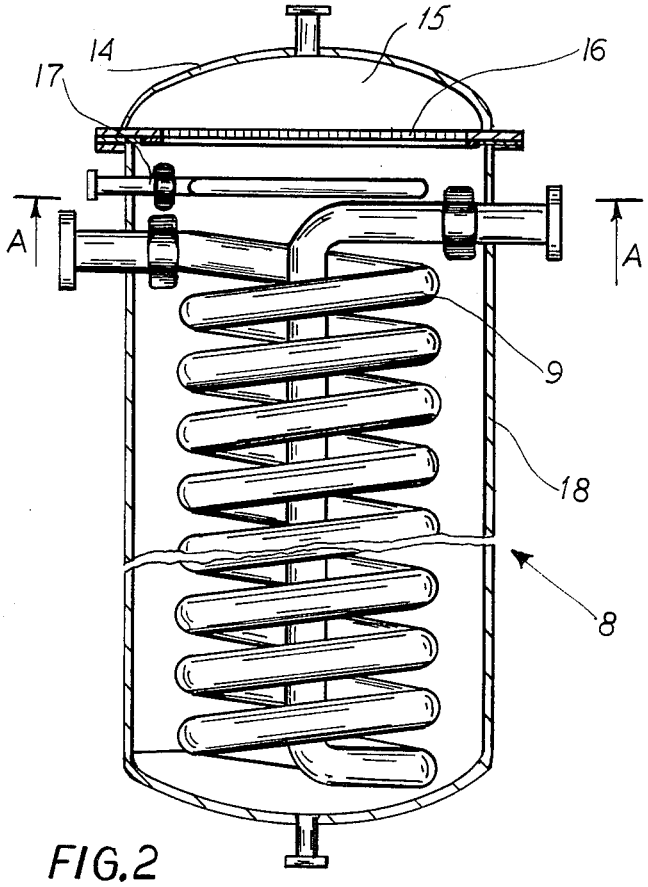
FIG. 2 is a longitudinal sectional view through the evaporation vessel.
Figure 3:
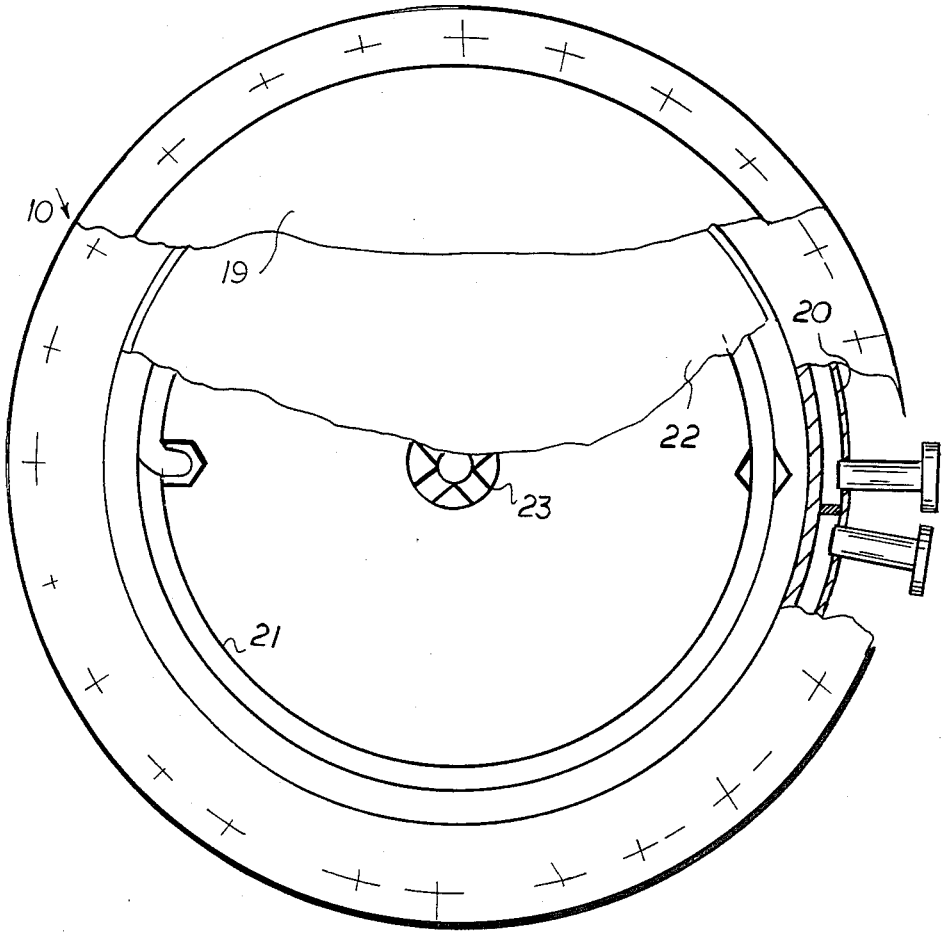
FIG. 3 is a cross-sectional view through the condenser and the condensate vessel.
Figure 5:
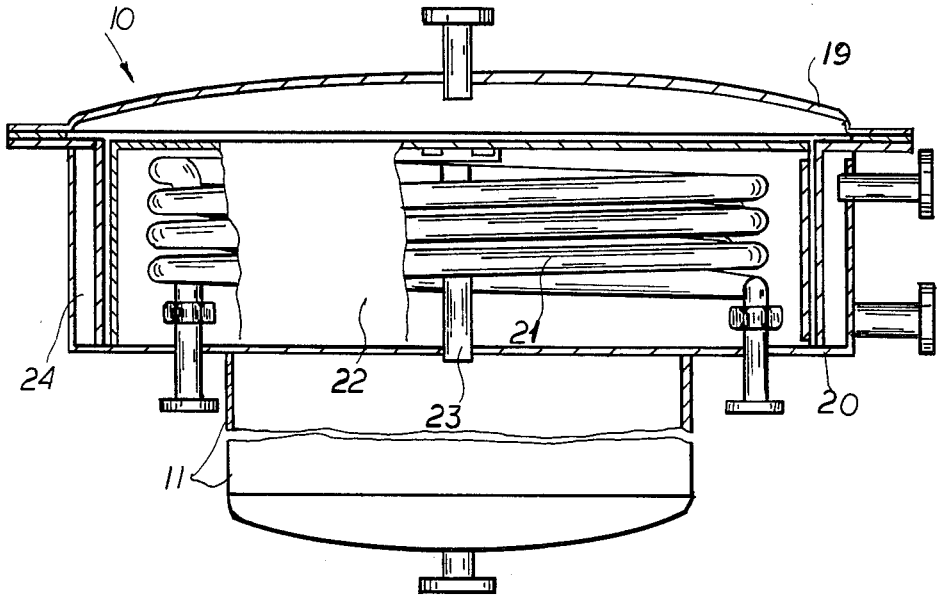
FIG. 5 is a longitudinal sectional view of the condenser.

The system according to the invention consists of a settling tank 1 with a steam heating coil 2, which is connected by means of a sludge pump SP to a sludge tank ST. There is provided a control unit which consists of gate valves 3 and 4 and a funnel 5 for checking the liquid delivered to the settling tank 1, as well as a drain 6 in the bottom of the settling tank 1. The latter is connected to an evaporation vessel 8 via valves, pipe conduits and a fuel pump 7. The external connections are arranged in such a way, that it is possible to discharge fuel from the settling tank 1 via the pump 7 to the top portion of the vessel 8, as well as from the bottom of the vessel 8 to the inlet in its top portion and from the bottom of vessel 8 to the working tank for boiler fuel WTBF. Within the housing 18 provided with cover 14 of the evaporation vessel 8 there is mounted a heating coil 9, above which there is disposed a toroid 17 formed with perforations along its bottom side. In the cover 14 of the vessel 8 there is provided a demister, which consists of a grid 16 and metal chips 15. The evaporation vessel 8 is connected to the condenser 10 via a pipe conduit from the cover 14 of the evaporation vessel 8 for the removal of the vapors. The condenser 10 comprises a housing 20 with an outer cooling jacket 24 and a cover 19. In the housing 20 there is mounted a diaphragm 22 formed with perforations around its bottom side from which an overflow pipe 23 extends. Underneath the diaphragm 22 there is disposed a cooling coil 21. The jacket 24 of condenser 10 is also connected to an outflow to the sea OS. Underneath the condenser 10 there is disposed a condensate vessel 11, shaped in a common housing and connected to the condenser 10 via an overflow pipe 23. Its top portion is connected to the suction side of the ejector 12, while its bottom portion is connected to the disinfestation tank DT. The ejector 12 is connected to a pump 13 for sea water for providing a carrying, and after the ejector 12—a cooling fluid for the jacket 24.

All components are mounted on a common frame with the exception of the settling tank 1, which can be built-in into the ship's body, and the sea water pump 13, which is disposed lower than the ship's water line.

The operation of the system is automated by means of a temperature controller connected to the heating coil 2 of tank 1, remotely controlled valves, level detectors in the evaporation vessel 8 and the condensate vessel 11, and a detector for water content in the fuels mounted in the pressure pipe conduit of the fuel pump 7.

The system according to the invention operates as follows: The sludge pump draws initially from the sludge tank water, which via gate valve 3 is discharged into the disinfestation tank. The gate valve 4 and the funnel 5 serve for inspection. When the gate valve 3 is closed, the fuels are discharged into the settling tank 1, where they are heated up to 80° C. during 10 to 12 hours. The separated water is drained through the drain 6. The sea water pump 13 is switched on and the ejector 12 produces a vacuum of 90 to 95%. At the same time, through the heating coil 9 there is passed heating water—cooling water of the main or auxiliary ship engine. The fuel pump 7 is switched on, which draws from the settling tank 1, and via the perforated toroid 17, the heating coil 9 is sprayed with emulsion. After the filling of the evaporation vessel 8, by switching over the remotely controlled valves, the fuel pump 7 then draws fuel from the bottom of the evaporation vessel 8 and discharges it again through toroid 17 until the desired desiccation of the fuels is achieved. The water and fuel vapors, purified from entrained drops by means of the demister, enter the condenser 10. The condensation takes place primarily on the vertical wall of the cooling jacket 24 and partially on the vertical wall of the perforated diaphragm 22. The non-condensed vapors pass through the holes in the diaphragm 22 and bubble (sparge) through the condensate catch formed by cooling coil 21, where there is maintained a temperature considerably lower than the temperature of condensation of the fuel vapors at the given pressure. Thus it is ensured that no fuel vapors will get into the carrying flow of the ejector 12. The condensate passes over into the condensate vessel 11 via the overflow pipe 23. After the desiccation of the fuels, the vessels are relieved from vacuum, and the fuel pump 7 pumps out the fuels from the bottom of the evaporation tank 8 into the working tank for boiler fuel. The condensate from the condensate vessel 11 is transfered by gravitation into the disinfestation tank. The disiccation of fuels is effected in portions (batches) until the settling tank 1 is emptied.

I claim:

1. A shipboard system for the recovery of fuel oil from sludge comprising:

a sludge tank for holding a mixture of sludge and fuel oil from the flushing of a heavy-oil purifier;

a settling tank provided with a first steam heating coil for heating said mixture;

a sludge pump connected between said sludge tank and said settling tank for feeding said mixture to said settling tank;

an evaporation vessel for the desiccation of said mixture;

a fuel pump connected between said settling tank and said evaporation vessel for feeding said heated mixture to said evaporation vessel, a bottom portion of said evaporation vessel being connectable to a fuel tank;

a condenser connected to said evaporation vessel and formed with an overflow pipe;

a condensate vessel connected to said condenser by said overflow pipe, a bottom portion of said condensate vessel being connectable to a disinfestation tank;

an ejector having the vacuum side thereof connected to a top portion of said condensate vessel and the pressure side thereof connected to said condenser; and a control unit connected at the connection between said sludge pump and said settling tank and including a plurality of gate valves feeding into a funnel for the visual inspection of said mixture and a drain provided at the bottom of said settling tank, said funnel and said drain being connectable to said disinfestation tank.

2. The shipboard system defined in claim 1 wherein said evaporation vessel comprises:

a housing centered on an upright axis and formed with a fuel oil outlet at a bottom portion thereof;

a cover on said housing formed with a water and fuel vapor outlet for feeding same to said condenser;

a second heating coil disposed in said housing centered on said axis;

a toroidal spray head disposed in said housing above said second heating coil and centered on said axis, said spray head being connectable to said fuel pump to spray said mixture from said settling tank on said second heating coil; and a demister disposed in said cover for purifying said water and fuel vapors feeding through said outlet formed therein, said demister being formed by an agglomeration of metal chips held in place by a grid.

3. The shipboard system defined in claim 1 wherein said condenser comprises:

a housing centered on an upright axis and provided with a cover formed with a water and fuel vapor inlet connected to said water and fuel vapor outlet of said evaporation vessel;

a diaphragm disposed in said housing centered on said axis, said diaphragm being formed with a plurality of perforations along a lower portion of a vertical wall thereof;

a cooling coil disposed in said diaphragm centered on said axis;

an overflow pipe disposed in said diaphragm and extending through a lower side of said housing; and a cooling jacket disposed in said housing centered on said axis and closely spaced from said diaphragm to form with the vertical wall thereof a narrow gap.

* * * * *